US007707960B1

(12) United States Patent
Cullop

(10) Patent No.: US 7,707,960 B1
(45) Date of Patent: May 4, 2010

(54) FLAG RESTRAINT

(75) Inventor: James Russell Cullop, Beckley, WV (US)

(73) Assignee: James R. Cullop, Beckley, WV (US)

( * ) Notice: Subject to any disclaimer, the term of this patent is extended or adjusted under 35 U.S.C. 154(b) by 50 days.

(21) Appl. No.: 12/287,967

(22) Filed: Oct. 15, 2008

(51) Int. Cl.
*G09F 17/00* (2006.01)

(52) U.S. Cl. ..... 116/174; 248/534; 40/607.11

(58) Field of Classification Search ..... 116/173–175; 40/660, 607.11–607.14; 284/534, 536, 539–541; 248/68.1
See application file for complete search history.

(56) References Cited

U.S. PATENT DOCUMENTS 984,884 A * 2/1911 Blank ..... 116/173
1,020,396 A * 3/1912 Blank ..... 116/173
1,253,380 A * 1/1918 Hoffman ..... 116/174
1,337,237 A * 4/1920 Light ..... 116/173
1,396,787 A * 11/1921 Shepard ..... 116/173
5,237,955 A * 8/1993 Jennings ..... 116/174
5,255,627 A * 10/1993 Williams ..... 116/174
5,697,321 A * 12/1997 Dobbins ..... 116/174
6,923,141 B1 * 8/2005 Staats et al. ..... 116/173
2007/0044703 A1 * 3/2007 Vickroy ..... 116/173

FOREIGN PATENT DOCUMENTS

CH 621884 A * 2/1981

* cited by examiner

*Primary Examiner*—Amy Cohen Johnson

(57) ABSTRACT

An apparatus for the prevention of flag entanglement upon a flagstaff that is comprised of a specifically milled wood block which acts as an attaching mechanism to the flagstaff and is the hinge point for a metal rod that is attached to the flag. The hinge point of the block allows the rod to swing in a 180 degree arc from the 90 degrees to 270 degrees. The length of the rod being equal to or greater than the width of the flag in conjunction with the hinge block action prevents the flag from flipping over and tangling on the staff.

3 Claims, 4 Drawing Sheets

FIG 2 ITEM 4

FIG 3 ITEM 3

FLAG RESTRAINT

BACKGROUND OF THE INVENTION

Seasonal flags and banners have become increasingly popular in the past 20 years. It is rare that when driving through towns or residential areas that you won't see a flag or banner flipped over and tangled on its' staff. There have been attempts to prevent this by adding rods across the bottom in the seam, adding weight in the corners, and attaching the flag to rotating rings on the staff. In the past, I flew my American flag on a vertical staff; however, I recently started flying my flag on a slightly elevated staff. I found that I had the same problem other people have. As a result, I started to search for ways to prevent the furling of a flag on its staff. This inventor has not found any of the past methods as effective as the flag restraint I have invented and tested.

BRIEF SUMMARY OF THE INVENTION

This invention being disclosed is comprised of 9 parts with 3 parts duplicated making a total of 12 parts, which when assembled and installed on a horizontal flag staff, will prevent the flag or banner from flipping over and tangling on its staff. The hinge block (FIG. 1), (Item 4) is milled and mounted so that in conjunction with the 30 inch rod acts as a pendulum activated by the movement of the flag. Accordingly, with all parts assembled with the flag restraint mounted to the flag staff and the clip attached to the flag, by design the pendulum action is restricted to a 180 degree arc at the 90 degree and 270 degree points. With the 30 inch rod being connected to a standard size decorative flag, or a 30 inch×48 inch American flag, the remaining portion of the flag is not of sufficient length to flip over and become tangled on the staff and the flag is able to fly freely.

Item 1 2 each #6-32 wing nuts used with Items 2 and 6.

Item 2 2 each #6 flat washers used with Items 1 and 6.

Item 3 Top of milled block separated is used as the clamp.

Item 4 Bottom of milled block (hinge block) containing the hinge point where the rod is to be connected.

Item 5 ¾ inch steel pin to connect rod (Item 7) to hinge block (Item 4).

Item 6 2 each 2 inch #6-32 screws to be inserted through 2 (two) ⅛ inch holes. Items 4 and 3, used with Items 1 and 2, hold the top of milled block and the bottom of milled block to form a clamp around the flag staff.

Item 7 30 inch rod with the end shaped and a 3/32 inch hole drilled in each end to allow connection to the hinge block (Item 4) and the "S" hook (Item 8).

Item 8 Open "S" hook to connect the rod (Item 7) to the clip (Item 9).

Item 9 Clip, often referred to as a personnel badge clip (Alligator clip), that attaches the restraint to the flag.

Figure 2:
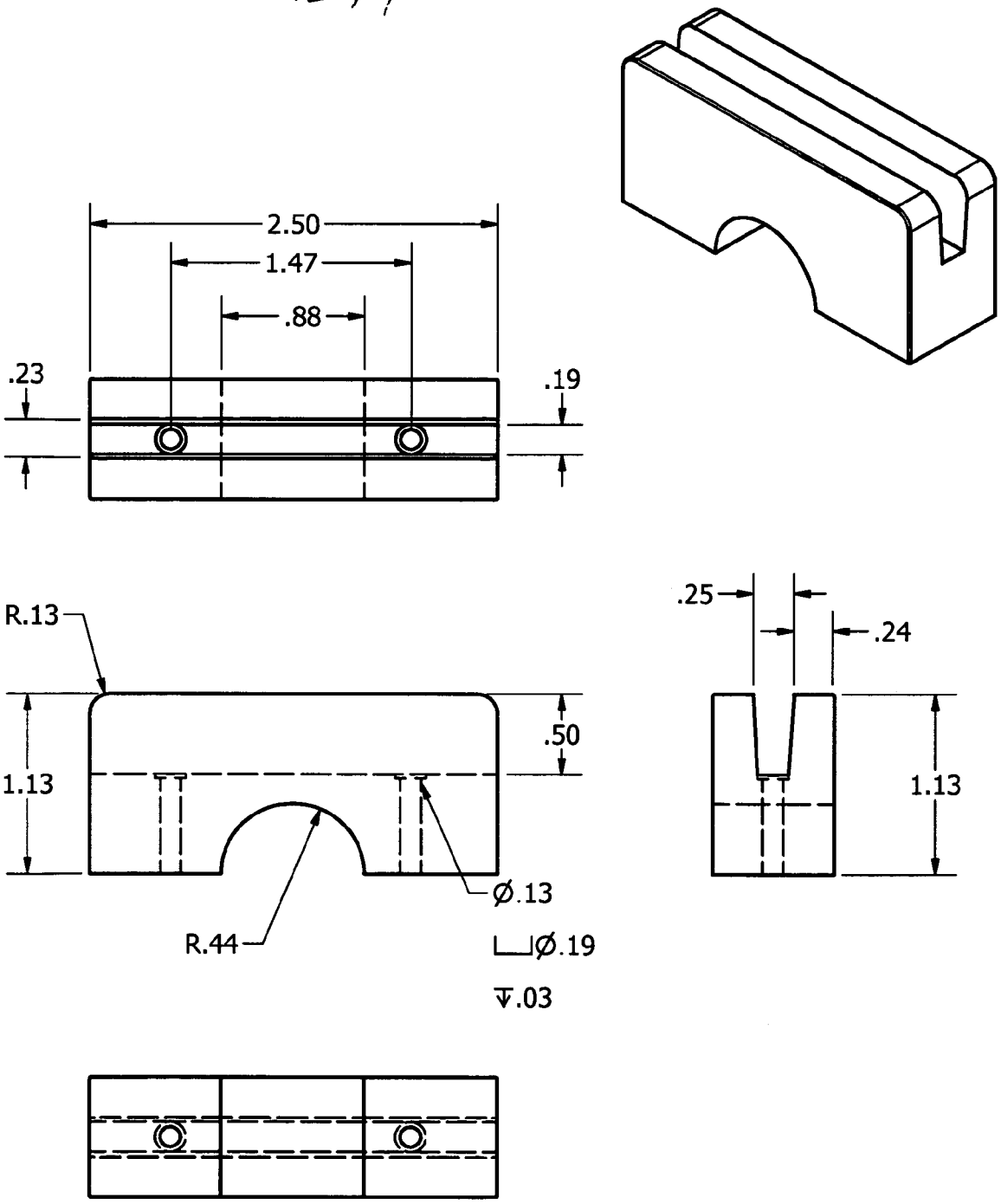

FIG. 2 is a view showing 5 angles of Item 4, the lower section of the block (hinge block).

Figure 3:
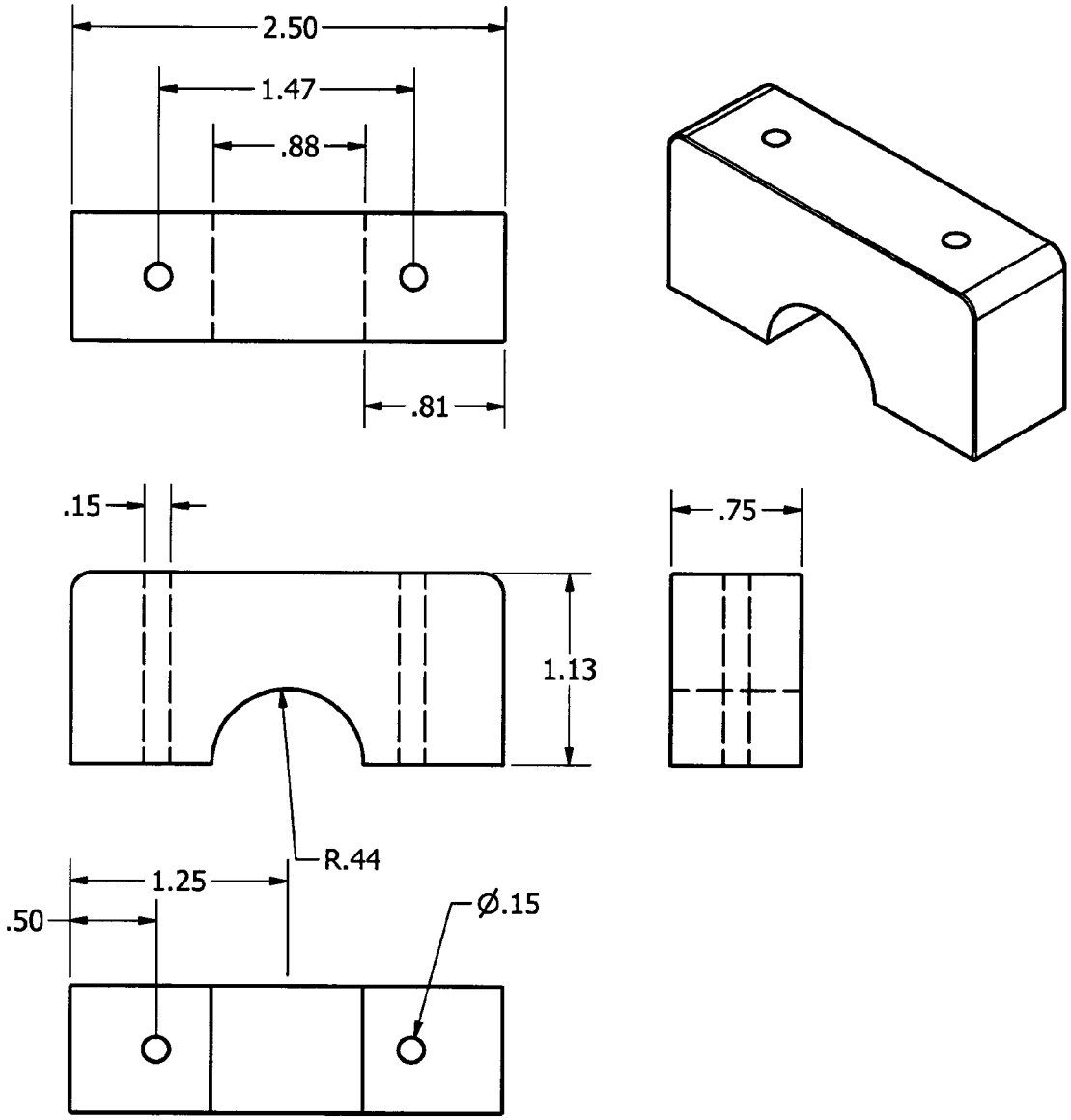

FIG. 3 is a view showing 5 angles of Item 3, the upper section of the block (clamp block).

Figure 4:
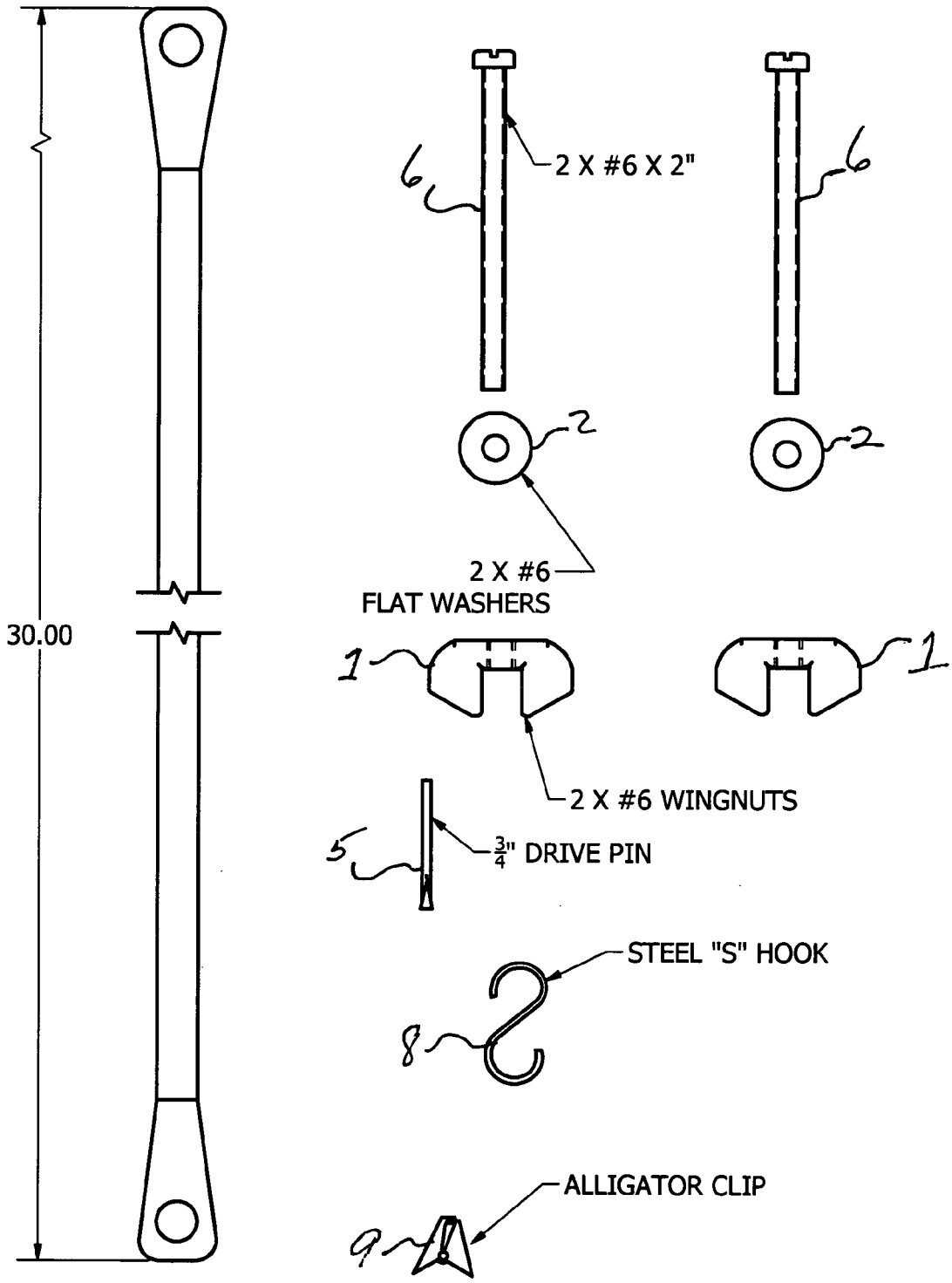

FIG. 4—is a view showing all the hardware used for assembling the restraint.

DETAILED DESCRIPTION OF INVENTION

Figure 1:
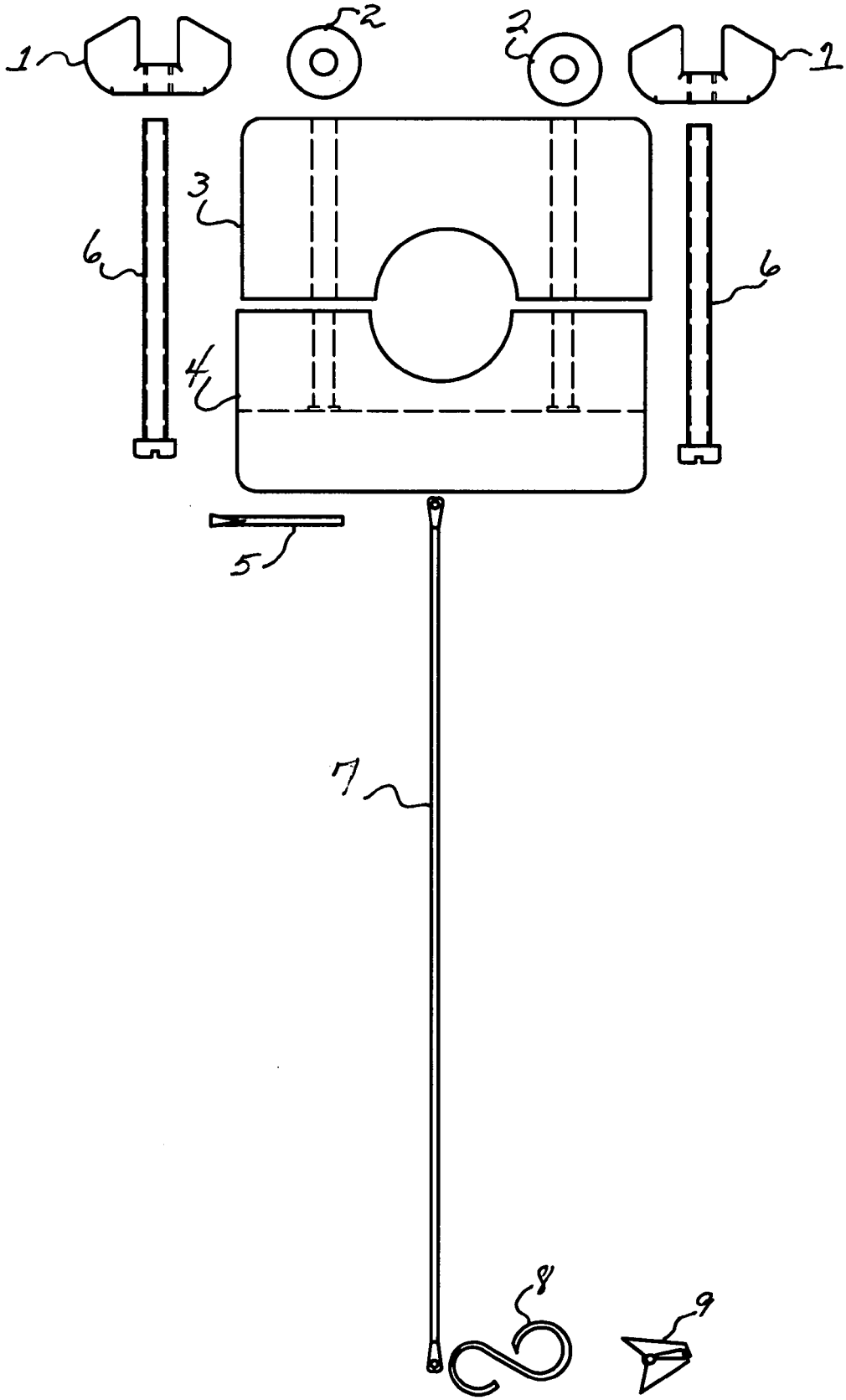
FIG. 1

Referring to the flag restraint shown in FIG. 1, when properly installed on a horizontal or elevated flag staff, the first 30 inches of the flag is restricted to a 180 degree arc (90 to 270 degrees). However, the flag will continue to fly naturally due to the pendulum action of the rod.

The hinge block (FIG. 1, Item 4) was milled from a 2¼×2½×¾ inch block of wood in which a ¼ inch wide, ½ inch deep groove is milled across the entire bottom of the block. At the top of the block, 2 each ⅛ inch holes are drilled 1½ inches apart and being ½ inch from the ends and centered from the back to front (⅜ inch). These holes are drilled to intersect with the ¼ inch wide milled groove at the bottom of the block. A 1/32 inch hole is drilled ¼ inch from the bottom and centered on the width of the block 1¼ inches from the sides. This hole will pass through the milled groove to the back of the block. A ¼ inch drill is used to mill out the two (2) each ⅛ inch holes in the milled groove 3/16 inch deep to facilitate the ¼ inch heads of the 2 each 2 inch #6-32 screws to be inserted through the ⅛ inch holes in the milled groove and to the top of the block.

At the intersect point of a horizontal line 1 inch below and parallel with the top of the hinge block and a vertical line being centered 1¼ inches from the sides, a ⅞ inch hole is drilled through the block. The block is cut on the horizontal line through the center of the ⅞ inch hole in which forms a saddle on the lower portion of the block and a clamp at the top. The two (2) ⅛ inch holes in the top block are drilled to 3/16 inch to permit the block to slide over the #6-32 screws and act as a clamp.

Assembly of the flag restraint consists of the following procedures:

- Insert the 2 each 2 inch #6-32 screws through the 2 each ⅛ inch holes. Insert from the milled groove through the hinge block (Item 4) through the top of the milled block (Item 3).
- Install a #6 washer (Item 2) on each protruding screw.
- Install the wing nuts (Item 1) onto each of the screws and tighten by hand.
- Position the rod (Item 7) at the point in the milled groove, on the bottom of the hinge block, where the ¾ inch pin (Item 5) can be driven through the 1/16 inch drilled hole and the 3/32 inch drilled hole in the rod end.
- Connect the open "S" hook (Item 8) to the clip (Item 9) and compress it closed. Connect the other end of the "S" hook through the remaining 3/32 inch hole in the rod and compress it closed.

TECHNICAL FIELD OF INVENTION

This invention relates in general, but not limited to, 28 inch×40 inch decorative flags mounted on a horizontal or elevated plane, and the prevention of flags tangling on the flagstaff.

What I claim is:

1. A flag restraint device designed for use on an existing flag or banner system, said system having a staff, with a first and second end, mounted on a horizontal or elevated plane and a flag attached to said staff by attachment means of eyelets or a banner sleeve, said flag restraint device comprising;

a milled wood hinge block having a front, a back, a top, a bottom, and two sides with said bottom having a groove milled horizontally between said front and said back, said hinge block further having a drilled hole centered one inch below the top and centered between the two sides, and further milling of said hinge block side to side through the center of said drilled hole wherein dividing said hinge block and forming a clamp, said clamp being a means to attach said device to the first or second end of said staff adjacent to the attachment means of said flag;

an elongated rod having a first and second end with a hole drilled in the first and second ends as an attachment means, with the first end of said elongated rod attaching to the said hinge block in the center of said milled groove thereby forming a hinge point wherein the milled groove guides the elongated rod; and a standard spring clip is attached to the second end of said elongated rod and clipped to said flag in an area adjacent to the second end of said rod, wherein said flag restraint device permits said flag to fly freely from side to side to a limit determined by the relationship of said rod and the milled groove.

2. The flag restraint device of claim 1, in which the milled wood hinge block is made of plastic, metal, or fibrous material.

3. The flag restraint device of claim 1, in which the elongated rod is made of wood, plastic, metal, or fibrous material.

* * * * *